US006135931A

United States Patent [19]

Padula, Od, II et al.

[11] Patent Number: 6,135,931

[45] Date of Patent: Oct. 24, 2000

[54] PHYSICAL THERAPY DEVICE FOR CORRECTING GAIT AND BALANCE PROBLEMS

[76] Inventors: William V Padula, Od, II, P.O. Box 1408, Guilford, Conn. 06437; William V Padula, I, 8037 Bellevista Ct., Spring Hill, Fla. 34606-7210; William V Padula, III, 90 Bargate Tr, Killingworth, Conn. 06419

[21] Appl. No.: 09/324,063

[22] Filed: Jun. 1, 1999

[51] Int. Cl.[7] ..... A63B 21/02

[52] U.S. Cl. ..... 482/74; 482/148; 482/907

[58] Field of Search ..... 482/148, 907, 482/91, 105, 74, 77

[56] References Cited

U.S. PATENT DOCUMENTS 4,232,863 11/1980 Roach ..... 482/91
5,211,615 5/1993 Sides ..... 482/105
5,302,164 4/1994 Austin ..... 482/91
5,839,994 11/1998 Elbogen ..... 482/91
5,842,960 12/1998 Yu ..... 482/131

*Primary Examiner*—Jerome Donnelly
*Attorney, Agent, or Firm*—Koda & Androlia

[57] ABSTRACT

A physical therapy device for correcting gait and balance. The device generally includes a rectangular frame having front, back, right and left sides, a vertical member extending downwardly from a center of the back side of the frame and longitudinal grips extending downwardly from intersections of the front side with each of the left and right sides. In use, the user stands within the generally rectangular frame with his forearms extending forward perpendicularly from the body and gripping the longitudinal grip members with the back side of the frame extending substantially horizontally across the shoulder blades of the user and the vertical member extending downwardly between the shoulder blades of the user.

7 Claims, 1 Drawing Sheet

PHYSICAL THERAPY DEVICE FOR CORRECTING GAIT AND BALANCE PROBLEMS

BACKGROUND OF THE INVENTION

1. Field of the Invention

This invention relates to physical therapy devices and particularly to physical therapy devices used for correcting gait and balance problems caused by neurological dysfunction.

2. Prior Art

Following neurological damage caused by a cerebrovascular accident (CVA), traumatic brain injury (TBI), cerebral palsy (CP), multiple sclerosis (MS) and others, persons will often experience neuromotor difficulties as well as visual dysfunctions which interfere with posture, balance and gait. These visual dysfunctions then have a significant detrimental effect upon the ambulation or mobility of the person.

Studies have determined that visual midline shift syndrome (VMSS) as a visual syndrome will affect balance, posture and ambulation. Persons with visual midline shift syndrome will shift their concept of the visual midline of their body away from the center causing them to lean, in most cases, in the direction of the midline shift. This can cause a tendency to lean or drift when walking to the right or the left. In addition, anterior and posterior shift of the axis may cause the individual to lean forward or backward. Visual midline shift syndrome not only affects ambulation but also posture while seated.

It has also been determined that individuals which have experienced neurological damage which interfered with their posture, balance and gait will further restrict counter-torsional movements of their upper body when attempting to walk. The purpose of the counter-torsional movement is to assist with balance. For example, in normal walking patterns when a foot and a leg is extended, the person rotates the upper body and the upper side forward. In other words, a step with the left foot will produce a rotation of the right shoulder and a swing of the right arm forward in order to counter-balance the movements of the lower body. In normal walking/gait patterns, this produces a swinging motion of the arms due to the counter-rotation of the upper body. Often in conjunction with a visual midline shift syndrome and/or other neurological problems, individuals will restrict the movement of the upper body or develop a pathological gait pattern, causing the shoulder and arm of the same side of the body as the foot that is extended to be rotated forward. This causes these individuals to have difficulties with balance, coordination, gait and ambulation.

The treatment for visual midline shift syndrome (VMSS) typically includes the use of yoked prisms to shift the midline back to the center. However, while the yoked prisms may shift the midline back to the center, in most cases the persons still retain a restricted and undifferentiated upper body movement and/or what is known as homolateral movement. This residual homolateral movement causes the shoulder and arm of the same side to be rotated forward in relation to the foot and leg on the same side and still causes some difficulties with balance, coordination, gait and ambulation.

SUMMARY OF THE INVENTION

Accordingly, it is a general object of the present invention to provide a device which is useful for correcting gait and balance problems in individuals with neurological damage.

It is still another object of the present invention to provide a physical therapy device for correcting homolateral movement.

It is still further an object of the present invention to provide a physical device for correcting gait and balance problems caused by homolateral movement which is capable of being inexpensively and easily manufactured and used.

In keeping with the principles of the present invention, the objects are accomplished by a unique physical therapy device for correcting gait and balance problems. This physical therapy device includes a generally rectangular frame comprising front, back, right and left sides. The front and back sides are substantially equal in length and are equal to a width of the shoulders of a user. The right and left sides are also substantially equal in length and are equal to a distance from a palm or closed fist to a back of a user along a forearm extending substantially perpendicular to the back or body of the user. A grip extends downwardly from each of the inner sections of the front side with each of the left and right sides. In addition, a downwardly extending tube is provided in the center of the back side of the frame.

In use, the user stands within the frame with his forearms extending forward perpendicularly from the body of the user and gripping the grips with the back side of the frame extending substantially horizontally across the shoulder blades of the user and the downwardly extending tube provided between the shoulder blades of the user.

BRIEF DESCRIPTION OF THE DRAWINGS

The above-mentioned features and objects of the present invention will become more apparent with reference to the following description taken in conjunction with the accompanying drawings wherein like reference numerals denote like elements and in which.

DETAILED DESCRIPTION OF THE INVENTION

Figure 2:
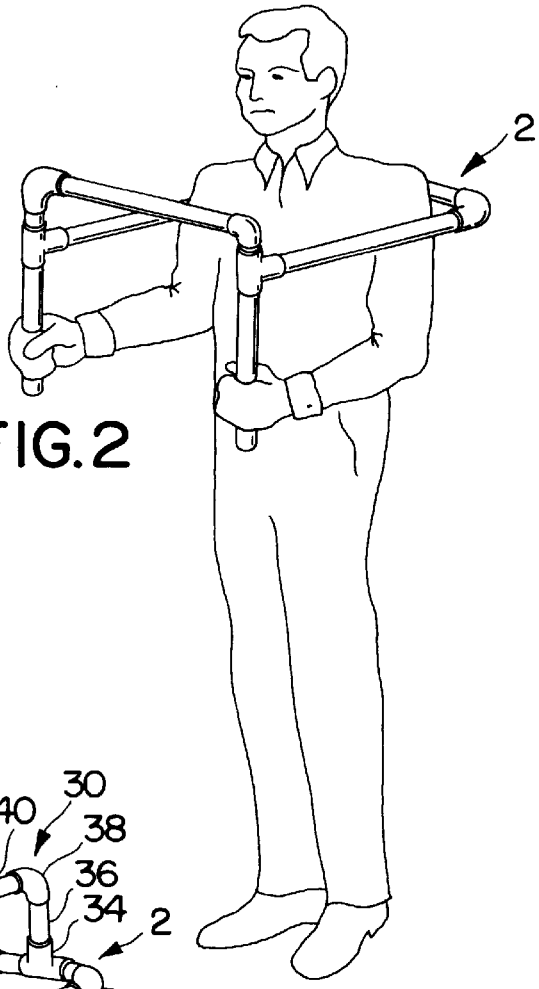
FIG. 2 is a view illustrating the first embodiment of the present invention in use.

The present invention essentially comprises a lightweight hand-held rectangular frame 2 which may be made out of hollow tubing such as PVC or other materials and is for the purpose of providing cues to an individual to have a position sense and an understanding of counter-torsional movements. The rectangular frame 2 comprises a front 4 and a back 6 together with left and right sides 8 and 10. The front 4, back 6, right 8 and left 10 sides are coupled together via elbows 12 and T-couplings 14.

In the approximate center of the back side 6 is provided a T-coupling 16 and extending downwardly therefrom is vertical member 18. For the purpose of convenience in storage or manufacture, the vertical member 18 is divided by a coupling 20. In addition, downwardly extending left and right hand grip members 22 are coupled to the rectangular frame 2 by means of the T-couplings 14.

Dimensionally, the device of the present invention should be arranged as follows:

1. The length of the front and back sides 4 and 6 is slightly larger than the width of the shoulders of a user;
2. The length of the right and left sides 8 and 10 is substantially equal to the distance from a palm or closed fist on a forearm extended forward to the back of the user with the forearm held perpendicular to the body of the user;
3. The height of the grip members 22 should be such that when the forearms are substantially perpendicular to the body, the back member 6 is placed in substantially the plane of the shoulder blades; and 4. The length of the vertical member 18 should be such that it extends downwardly from the shoulder blades to the coccyx of the spine.

While the present invention could be custom built for each individual user based upon the above-stated dimensions, it would be advantageous and within the skill of one of ordinary skill in the art to make the various dimensions of the device of the present invention adjustable to be able to optimize them for any particular user and in that way provide a device which can be mass produced at a low cost.

Referring to FIG. 2, in operation the user holds the grip members 22 in both hands and then positions the device so that the back side 6 is in the plane of the shoulder blades of the user. By pushing the arms of the user forward, the back side 6 presses into the axis of the shoulders at or above the level of the shoulder blade. The vertical member 18 acts as an orientation for the vertical axis when the rotational movement curves.

When the user steps forward with a foot, i.e. left foot, the device is torqued toward the foot extended, i.e. to the left. The opposite movement occurs when the user brings the other foot forward. As a result, this produces an immediate counter-rotation of movement and disassociation of the upper torso relative to the trunk and lower torso.

As a result of the above, the device of the present invention provides the sensory cues to the user to enable the user to correct his or her difficulties with balance, coordination, gait and ambulation.

Figure 3:
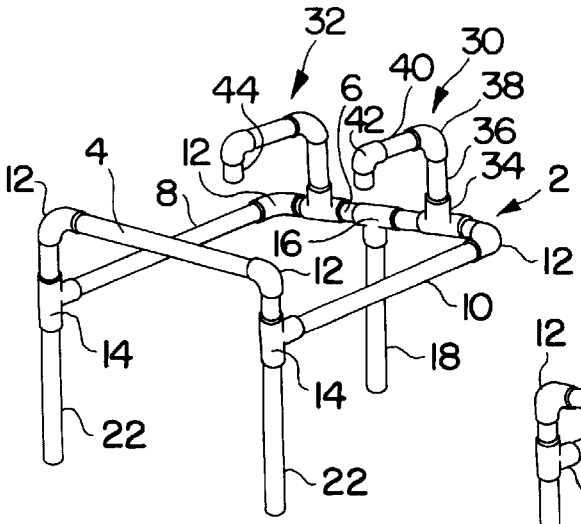
FIG. 3 is a perspective view of a second embodiment of the present invention.
Figure 1:
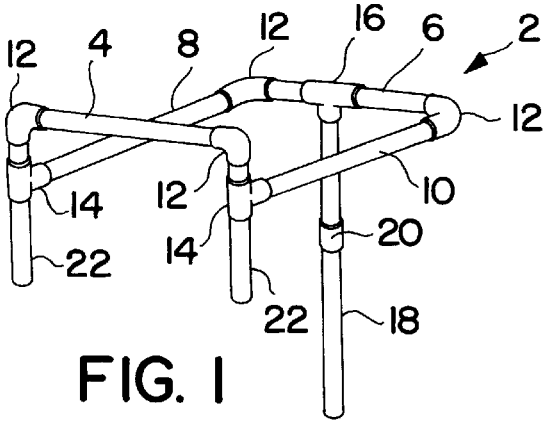
FIG. 1 is a perspective view of a first embodiment of a device in accordance with the teachings of the present invention.

Referring to FIG. 3, shown therein is a second embodiment of the present invention. All the elements of this second embodiment which are the same as the first are given like reference numerals. In this second embodiment, additional visual cues to those given in the first embodiment are provided to the user. In particular and as is shown in FIG. 3, left and right extensions 30 and 32 are provided. These left and right extensions 30 and 32 extend up along the head of the user and in front of the user's face. In particular, of the left and right extensions 30 and 32 comprise a T-coupler 34 provided in the back side 6, a vertically extending member 36 extending upward from the T-coupler 34, an elbow 38 provided on the end of the upwardly extending member 36, horizontally extending member 40 provided into elbow 38, elbow 42 provided on the end of horizontal member 40 and a short downwardly extending member 44 provided in the elbow 42.

In operation, this third embodiment operates substantially the same as the second, except that the left and right extensions 30 and 32 provide horizontal and vertical bars on the right and left sides of the person's face. The purpose of these horizontal and vertical bars is to visually represent an ambient or peripheral concept of the horizon and the vertical. Accordingly, the left and right extensions 30 and 32 provide orientation to the horizontal plane upon which the user is walking. These visual cues further assist the user with upright posturing and maintaining balance.

It should be further apparent that while the present invention has been described in terms of tubing and couplings, it would be also possible to manufacture the device by other means known to those of ordinary skill in the art. Such other means would include but are not limited to welding, braising, soldering, casting and injection molding. In addition, the present invention could be made from a variety of different materials which include metals, plastics, graphites and composite materials.

It should be apparent to those of ordinary skill in art that the above-described embodiments are merely illustrative of a few embodiments of the present invention; and numerous and various other arrangements of the present invention would be readily apparent to those skilled in the art without departing from the spirit and scope of the invention.

What is claimed is:

1. A physical therapy device for correcting gait and balance problems of a user, said device comprising:

a generally rectangular frame comprising front, back, right and left sides coupled together and generally lying in a same plane with said front and back sides parallel and said right and left sides parallel;

a first longitudinal member extending downwardly from and perpendicular to a center of said back side of said rectangular frame; and second and third longitudinal members extending downwardly from and perpendicular to intersections of said front side with said left and right sides;

whereby in use said user stands within said frame with his forearms extending forward perpendicularly from the body of the user and gripping the second and third longitudinal members with the back side of said frame extending substantially horizontally across the shoulder blades of the user and the first longitudinal member extending downwardly between the shoulder blades of the user and said user further supports said frame with said first, second and third longitudinal members spaced apart from a surface which supports said user.

2. A physical therapy device according to claim 1, wherein said front and back sides are substantially equal in length to a width of shoulders of a user.

3. A physical therapy device according to claim 2, wherein said right and left sides are substantially equal in length to a distance from a palm or closed fist to a back of said user along a forearm extending substantially perpendicular to said back of said user.

4. A physical therapy device according to claim 3, wherein said first longitudinal member is of a length substantially equal to the distance from the shoulder blades to the coccyx of the user.

5. A physical therapy device according to claim 1, further comprising a pair of spaced apart L-shaped members extending upwardly from and perpendicular to said back side of said rectangular frame with said first longitudinal member therebetween.

6. A physical therapy device for correcting gait and balance problems of a user, said device consisting of:

a generally rectangular frame comprising front, back, right and left sides;

a first longitudinal member extending downwardly from and perpendicular to a center of said back side of said rectangular frame; and second and third longitudinal members extending downwardly from and perpendicular to intersections of said front side with said left and right sides;

whereby in use said user stands within said frame with his forearms extending forward perpendicularly from the body of the user and gripping the second and third longitudinal members with the back side of said frame extending substantially horizontally across the shoulder blades of the user and the first longitudinal member extending downwardly between the shoulder blades of the user and said user further supports said frame with said first, second and third longitudinal members spaced apart from a surface which supports said user.

7. A physical therapy device for correcting gait and balance problems of a user, said device consisting of:

a generally rectangular frame comprising front, back, right and left sides;

a first longitudinal member extending downwardly from and perpendicular to a center of said back side of said rectangular frame;

second and third longitudinal members extending downwardly from and perpendicular to intersections of said front side with said left and right sides;

a pair of spaced apart L-shaped members extending upwardly from and perpendicular to said back side of said frame with said first longitudinal member therebetween; and whereby in use said user stands within said frame with his forearms extending forward perpendicularly from the body of the user and gripping the second and third longitudinal members with the back side of said frame extending substantially horizontally across the shoulder blades of the user and the first longitudinal member extending downwardly between the shoulder blades of the user and said user further supports said frame with said first, second and third longitudinal members spaced apart from a surface which supports said user.

* * * * *